US009400471B2

(12) United States Patent
Fukai

(10) Patent No.: US 9,400,471 B2
(45) Date of Patent: Jul. 26, 2016

(54) IMAGE FORMING APPARATUS

(71) Applicant: Konica Minolta, Inc., Chiyoda-ku, Tokyo (JP)

(72) Inventor: Shougo Fukai, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/962,360

(22) Filed: Dec. 8, 2015

(65) Prior Publication Data

US 2016/0170358 A1 Jun. 16, 2016

(30) Foreign Application Priority Data

Dec. 16, 2014 (JP) ..... 2014-254265

(51) Int. Cl.
*G03G 15/08* (2006.01)
*G03G 15/00* (2006.01)

(52) U.S. Cl.
CPC ..... *G03G 15/556* (2013.01)

(58) Field of Classification Search
USPC ..... 399/9, 24, 27–30, 252, 258, 264
See application file for complete search history.

(56) References Cited

U.S. PATENT DOCUMENTS 6,795,668 B1 * 9/2004 Nishiwaki ..... G03G 15/757 399/120
7,346,286 B2 * 3/2008 Matsumoto et al. ... G03B 15/08 399/259

FOREIGN PATENT DOCUMENTS

JP 2010072168 A 4/2010

* cited by examiner

*Primary Examiner* — Hoan Tran
(74) *Attorney, Agent, or Firm* — Cantor Colburn LLP

(57) ABSTRACT

An image forming apparatus includes a sheet conveyance section capable of conveying a long sheet; an electrophotographic image forming section; and a control section configured to control a toner refreshing operation. The toner refreshing operation includes a first toner refreshing operation and a second toner refreshing operation. In the first toner refreshing operation, an ejection toner image is formed on the image bearing member and removed by a cleaning section for the image bearing member, and in the second toner refreshing operation, an ejection toner image is formed on the image bearing member and the ejection toner image thus formed is transferred and fixed to the long sheet conveyed by the sheet conveyance section. When the toner refreshing operation is required, the control section executes the first toner refreshing operation or the second toner refreshing operation during an interval between jobs.

7 Claims, 6 Drawing Sheets

TONER REFRESHING OPERATION SETTING

ALLOW FOR TONER EJECTION TO ROLL SHEET? M1

YES NO

SELECT TONER REFRESHING OPERATION M2

1. WASTE SHEET REDUCTION MODE
2. TIME SHORTENING MODE
3. RECOMMENDED MODE

FIG. 5A

TONER REFRESHING OPERATION SETTING

ALLOW FOR TONER EJECTION TO ROLL SHEET? M1

YES NO

SELECT TONER REFRESHING OPERATION M2

1. WASTE SHEET REDUCTION MODE
2. TIME SHORTENING MODE (DISABLED)
3. RECOMMENDED MODE (DISABLED)

FIG. 5B

IMAGE FORMING APPARATUS

CROSS REFERENCE TO RELATED APPLICATIONS

This application is entitled to and claims the benefit of Japanese Patent Application No. 2014-254265, filed on Dec. 16, 2014, the disclosure of which including the specification, drawings and abstract is incorporated herein by reference in its entirety.

BACKGROUND OF THE INVENTION

1. Field of the Invention

The present invention relates to an electrophotographic image forming apparatus that can form an image on a long sheet.

2. Description of Related Art

In general, an electrophotographic image forming apparatus (such as a printer, a copy machine, and a fax machine) is configured to irradiate (expose) a uniformly-charged photoconductor (for example, a photoconductor drum) with (to) laser light based on image data to form an electrostatic latent image on the surface of the photoconductor. The electrostatic latent image is then visualized by supplying toner from a developing device to the photoconductor on which the electrostatic latent image is formed, whereby a toner image is formed. Further, the toner image is directly or indirectly transferred to a sheet through an intermediate transfer belt, followed by heating and pressurization for fixing, whereby an image is formed on the sheet.

It is known that, when a two-component developer is used in an electrophotographic image forming apparatus, an external additive is buried on the toner surface and removed from the toner in association with agitation of the toner and carrier in a developing device, thus degrading the toner. In particular, when a low-coverage image is continuously formed, toner is kept agitated in the developing device without being replaced, and consequently degradation of the toner is significant. When toner is degraded, charging performance is degraded and consequently image unevenness and image fogging may possibly be caused. In addition, when the toner concentration (the proportion of toner in two-component developer) cannot be properly controlled due to degradation of the toner, charging performance of the toner becomes further unstable, and consequently image fogging, toner scatter, or toner spilling may possibly be caused. In view of this, in general, toner refreshing intended to forcibly eject degraded toner and replace the degraded toner with new toner is performed (see, for example, Japanese Patent Application Laid-Open No. 2010-72168).

For example, in the case where images are formed on flat sheets, a toner image for ejecting the degraded toner (hereinafter referred to as "ejection toner image") is formed on an image bearing member (a photoconductor in the case of the direct transfer scheme, or an intermediate transfer belt in the case of the intermediate transfer scheme) in a region between a toner image transferred to a preceding sheet and a toner image transferred to a succeeding sheet (i.e., between images), and then collected with a cleaning section for the image bearing member, thereby forcibly ejecting the toner. At this time, the difference between the amount of the degraded toner generated by the image formation and the toner consumption amount is formed as an ejection toner image, and ejected. The ejection toner image passes through the transfer section in a period after the preceding sheet passes through the transfer section and before the succeeding sheet reaches the transfer section (i.e., the interval between sheets), and therefore the ejection toner image is not transferred to the sheet.

However, in the case where an image is formed on a long sheet such as a roll sheet and a continuous sheet (continuous form sheet), it is difficult to form an ejection toner image between images to forcibly eject the toner unlike the case where images are formed on flat sheets. Specifically, since conveyance of the long sheet is required to be ensured during the image formation process, it is impossible to use a configuration in which the pressure contact between the image bearing member and the long sheet is released only at a time when the ejection toner image formed between images passes through the transfer section. As a result, the ejection toner image formed between images is also transferred to the long sheet, and the quality as a long product is significantly degraded when a plurality of successive images are produced as one printing material.

SUMMARY OF THE INVENTION

An object of the present invention is to provide an image forming apparatus that can efficiently perform toner refreshing in accordance with applications of the user without degrading the quality as a long product when an image is formed on a long sheet.

To achieve at least one of the abovementioned objects, an image forming apparatus reflecting one aspect of the present invention includes: a sheet conveyance section capable of conveying a long sheet; an image forming section configured to form a toner image on an image bearing member by supplying toner from a toner development section, and transfer and fix the toner image to the long sheet conveyed by the sheet conveyance section; a control section configured to control a toner refreshing operation in which toner housed in the development section is ejected by an amount required to be ejected and is replaced with new toner, wherein the toner refreshing operation includes a first toner refreshing operation and a second toner refreshing operation, the first toner refreshing operation being an operation in which an ejection toner image is formed on the image bearing member and removed by a cleaning section for the image bearing member, the second toner refreshing operation being an operation in which an ejection toner image is formed on the image bearing member and the ejection toner image thus formed is transferred and fixed to the long sheet conveyed by the sheet conveyance section, and, when the toner refreshing operation is required, the control section executes the first toner refreshing operation or the second toner refreshing operation during an interval between jobs, the interval being a period between completion of an image formation process of a preceding printing job and start of an image formation process of a succeeding printing job.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein:

FIG. 5A illustrates an exemplary operation screen for setting the toner refreshing operation;

FIG. 5B illustrates another exemplary operation screen for setting the toner refreshing operation.

DESCRIPTION OF THE PREFERRED EMBODIMENTS

In the following, an embodiment of the present invention will be described in detail with reference to the accompanying drawings.

Figure 1:
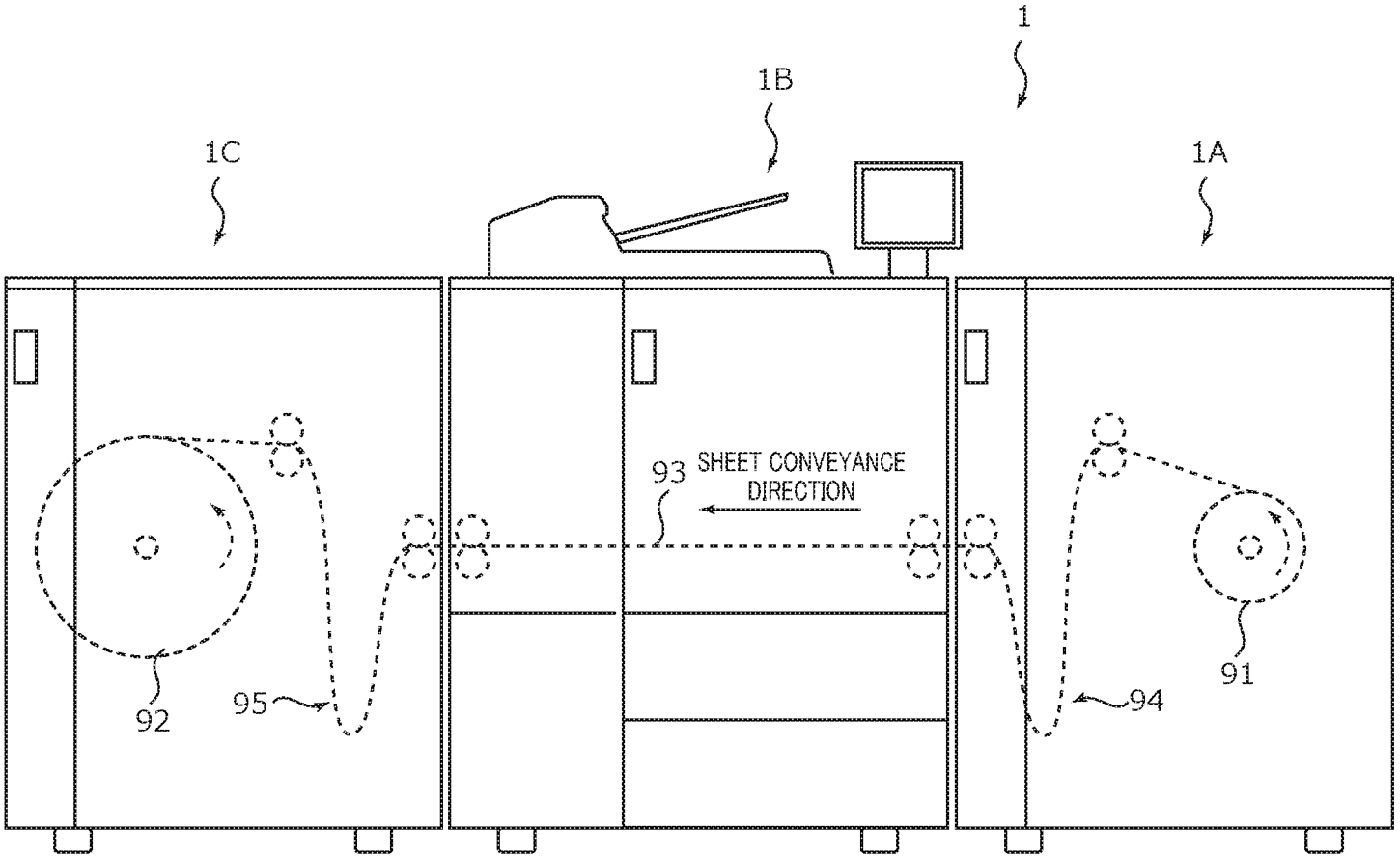
FIG. 1 illustrates an image forming apparatus according to an embodiment of the present invention.

FIG. 1 illustrates a configuration of image forming apparatus 1 according to the embodiment of the present invention.

Image forming apparatus 1 illustrated in FIG. 1 includes sheet feeding apparatus 1A, image forming apparatus main body 1B, and winding apparatus 1C. Image forming apparatus 1 forms an image on a roll sheet, and the present invention is suitable for a case where a long sheet such as a roll sheet and a continuous sheet, that is, a case where multiple images are continuously formed on a sheet having no sheet interval space.

Sheet feeding apparatus 1A includes roll sheet feeding section 91, sheet feeding side buffer section 94 and the like, and feeds a roll sheet under the instruction of image forming apparatus main body 1B. In sheet feeding side buffer section 94, for example, slackening of the roll sheet is absorbed with a vertically movable tension roller, an air blasting device that applies air to the roll sheet, a suction device that sucks the roll sheet or the like, and thus a proper tensile force is given to the roll sheet.

The roll sheet fed from sheet feeding apparatus 1A is conveyed along sheet feeding path 93. Image forming apparatus 1B forms an image on a roll sheet fed from sheet feeding apparatus 1A with use of an electrophotographic technique.

Winding apparatus 1C includes roll winding section 92 and winding side buffer section 95, and winds up a roll sheet on which an image has been formed by image forming apparatus main body 1B. Winding side buffer section 95 has a configuration similar to that of sheet feeding side buffer section 94.

Figure 2:
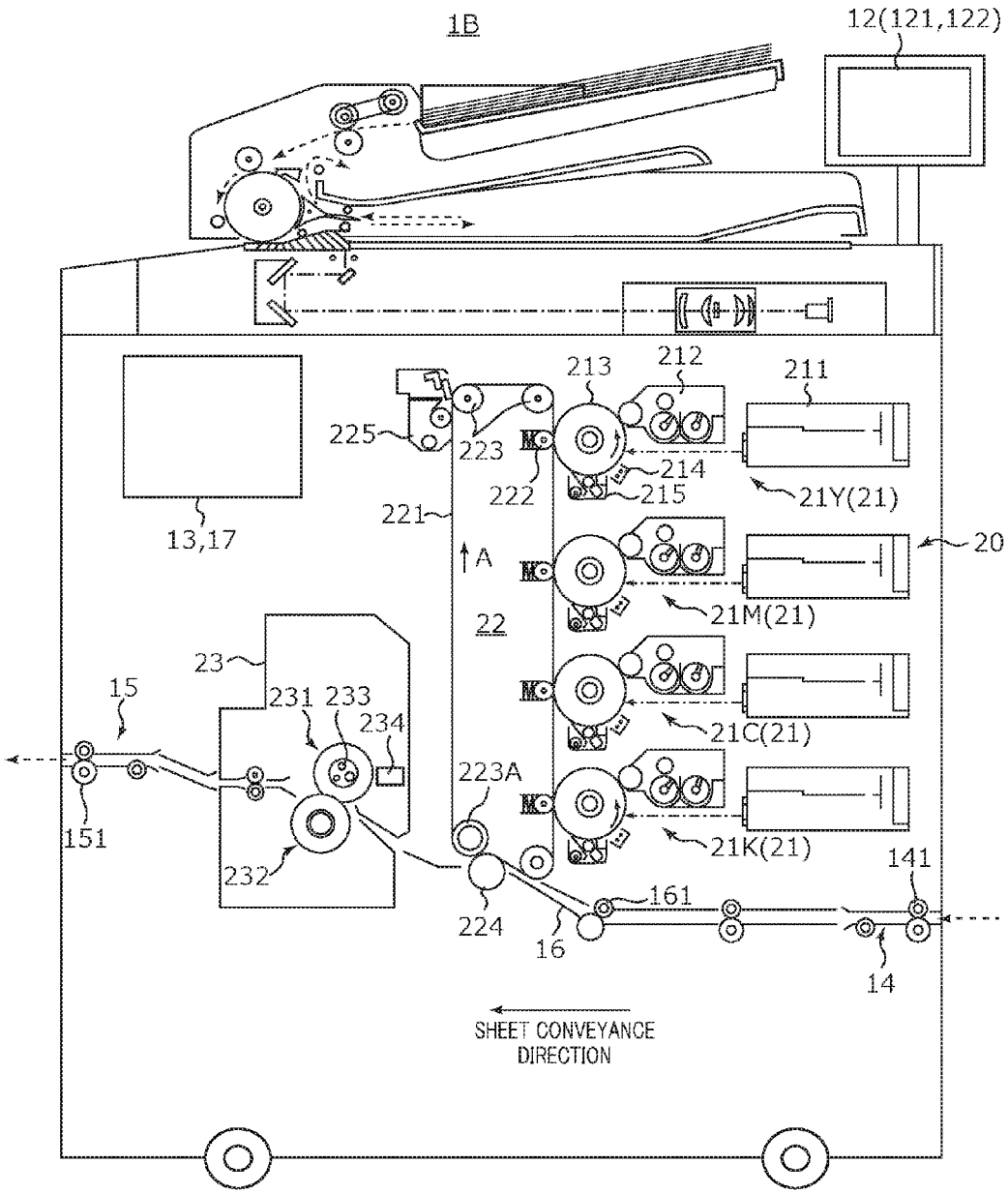
FIG. 2 illustrates a general configuration of an image forming apparatus main body.
Figure 3:
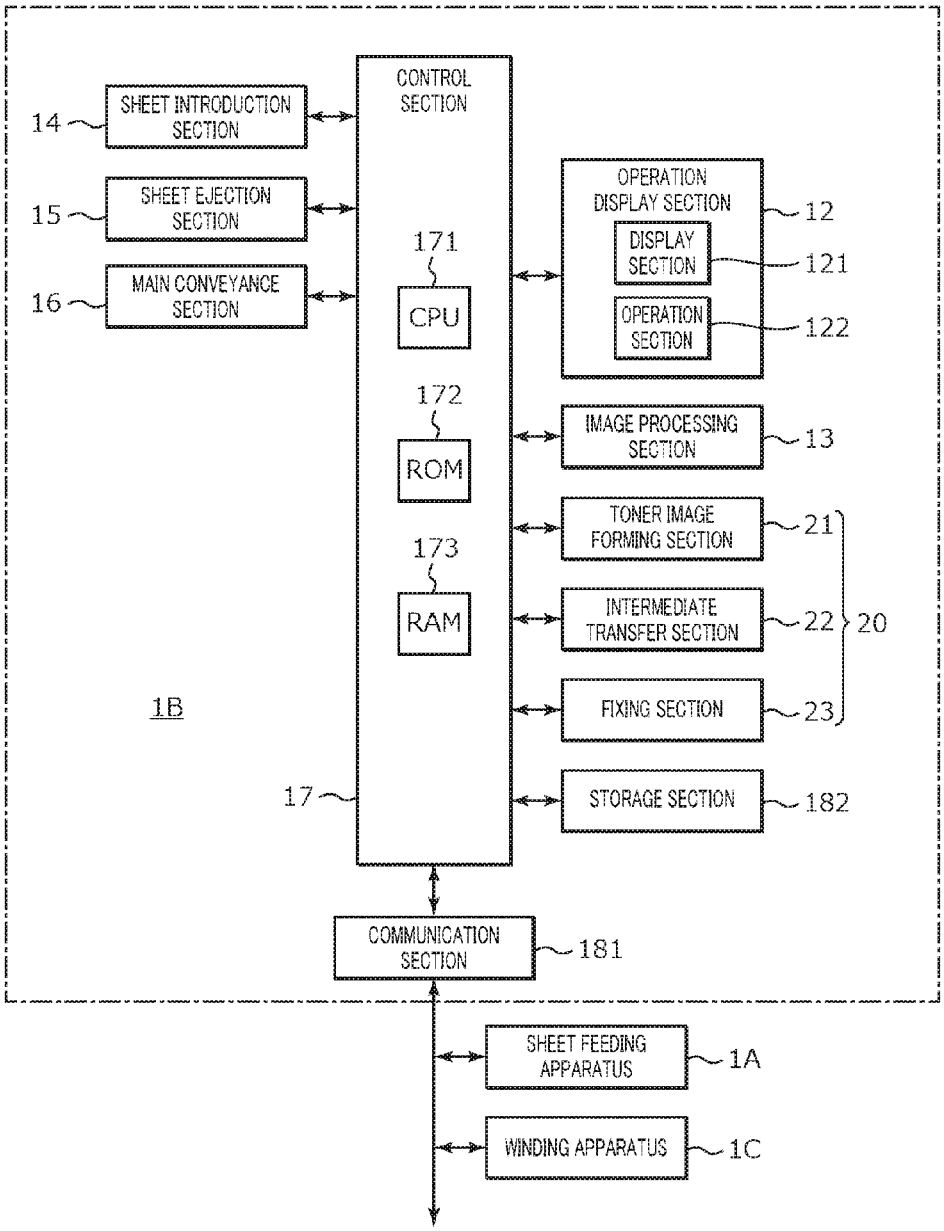
FIG. 3 illustrates a main part of a control system of the image forming apparatus main body.

FIG. 2 illustrates a general configuration of image forming apparatus main body 1B. FIG. 3 illustrates a principal part of a control system of image forming apparatus main body 1B.

Image forming apparatus main body 1B illustrated in FIGS. 2 and 3 is a color image forming apparatus of an intermediate transfer system using electrophotographic process technology. A longitudinal tandem system is adopted for image forming apparatus main body 1B. In the longitudinal tandem system, respective photoconductor drums 213 corresponding to the four colors of YMCK are placed in series in the travelling direction (vertical direction) of intermediate transfer belt 221, and the toner images of the four colors are sequentially transferred to intermediate transfer belt 221 in one cycle.

That is, image forming apparatus main body 1B transfers (primary-transfers) toner images of yellow (Y), magenta (M), cyan (C), and black (K) formed on photoconductor drums 213 to intermediate transfer belt 221, and superimposes the toner images of the four colors on one another on intermediate transfer belt 221. Then, image forming apparatus main body 1B transfers (secondary-transfers) the resultant image to a sheet, to thereby form an image. Intermediate transfer belt 221 serves as the image bearing member of the embodiment of the present invention.

As illustrated in FIGS. 2 and 3, image forming apparatus main body 1B includes operation display section 12, image processing section 13, image forming section 20, sheet introduction section 14, sheet ejection section 15, main conveyance section 16, and control section 17.

Control section 17 includes central processing unit (CPU) 171, read only memory (ROM) 172, random access memory (RAM) 173 and the like. CPU 171 reads a program suited to processing contents out of ROM 172 or storage section 182, develops the program in RAM 173, and integrally controls the operation of each block of image forming apparatus 1B, sheet feeding apparatus 1A and winding apparatus 1C in cooperation with the developed program.

Communication section 181 has various interfaces such as network interface card (NIC), modulator-demodulator (MODEM), and universal serial bus (USB), for example.

Storage section 182 is composed of, for example, a non-volatile semiconductor memory (so-called flash memory) or a hard disk drive. Storage section 182 stores therein a look-up table which is referenced when the operation of each block is controlled, for example.

Control section 17 transmits and receives various data to and from an external apparatus (for example, a personal computer) connected to a communication network such as a local area network (LAN) or a wide area network (WAN), through communication section 181. Control section 17 receives image data (input image data) of page description language (PDL) that has been sent from an external device, and controls the apparatus to form an image on a sheet on the basis of the data, for example.

Operation display section 12 includes, for example, a liquid crystal display (LCD) with a touch panel, and functions as display section 121 and operation section 122. Display section 121 displays various operation screens, image conditions, operating statuses of functions, and the like in accordance with display control signals received from control section 17. Operation section 122 includes various operation keys such as numeric keys and a start key, receives various input operations performed by a user, and outputs operation signals to control section 17. By operating operation display section 12, the user can perform setting relating to the image formation such as document setting, image quality setting, multiplying factor setting, application setting, output setting, and sheet setting. In addition, the user can set the toner refreshing operation by operating operation display section 12.

Image processing section 13 includes a circuit that performs a digital image process suited to initial settings or user settings on the input image data, and the like. For example, image processing section 13 performs tone correction on the basis of tone correction data under the control of control section 17. Image processing section 13 also performs various correction processes such as color correction and shading correction on the input image data. Image forming section 20 is controlled on the basis of the image data that has been subjected to these processes.

Image forming section 20 includes: toner image forming section 21 configured to form toner images of colored toners respectively containing a Y component, an M component, a C component, and a K component on the basis of the input image data; intermediate transfer section 22 configured to transfer a toner image formed by toner image forming sections 21 to a sheet; fixing section 23 configured to fix a transferred toner image to a sheet; and the like.

Toner image forming section 21 includes four toner image forming sections 21Y, 21M, 21C, and 21K for the Y component, the M component, the C component, and the K component, respectively. Since toner image forming sections 21Y, 21M, 21C, and 21K have similar configurations, common elements are denoted by the same reference signs for ease of illustration and description. Only when elements need to be discriminated from one another, Y, M, C, K is added to their reference signs. In FIG. 2, reference signs are given to only the elements of toner image forming section 21Y for the Y component, and reference signs are omitted for the elements of other toner image forming sections 41M, 21C, and 21K.

Toner image forming section 21 includes exposing device 211, developing device 212, photoconductor drum 213, charging device 214, drum cleaning device 215 and the like.

Photoconductor drum 213 is, for example, a negative-charge-type organic photoconductor (OPC) formed by sequentially laminating an under coat layer (UCL), a charge generation layer (CGL), and a charge transport layer (CTL) on the circumferential surface of a conductive cylindrical body (aluminum-elementary tube) made of aluminum. The charge generation layer is made of an organic semiconductor in which a charge generating material (for example, phthalocyanine pigment) is dispersed in a resin binder (for example, polycarbonate), and generates a pair of positive charge and negative charge through light exposure by exposure device 211. The charge transport layer is made of a layer in which a hole transport material (electron-donating nitrogen compound) is dispersed in a resin binder (for example, polycarbonate resin), and transports the positive charge generated in the charge generation layer to the surface of the charge transport layer.

Charging device 214 is composed of a corona discharging generator such as a scorotron charging device and a corotron charging device, for example. Charging device 214 evenly negatively charges the surface of photoconductor drum 213 by corona discharge.

Exposing device 211 is composed of, for example, an light-emitting diode (LED) print head including an LED array having a plurality of linearly laid out LEDs, an LPH driving section (driver IC) for driving each LED, and an lens array that brings light radiated from the LED array into an image on photoconductor drum 213, and the like. Each of the LEDs of LED array 1 corresponds to one dot of an image.

Exposure device 211 irradiates photoconductor drum 213 with light corresponding to the image of each color component. The positive charge generated in the charge generation layer of photoconductor drum 213 irradiated with light is transported to the surface of the charge transport layer, whereby the surface charge (negative charge) of photoconductor drum 213 is neutralized. Thus, an electrostatic latent image of each color component is formed on the surface of photoconductor drum 213 by the potential difference from its surroundings.

Developing device 212 stores developers of respective color components (for example, a two-component developer composed of toner and magnetic carrier). Developing device 212 attaches toner of respective color components to the surfaces of photoconductor drums 213, and visualizes the electrostatic latent image to form a toner image. To be more specific, a developing bias voltage is applied to a developer bearing member (developing roller), and an electric field is formed between photoconductor drum 213 and developer bearing member. By the potential difference between photoconductor drum 213 and the developer bearing member, the charging toner on the developer bearing member is caused to move and attach to a light exposure section on the surface of photoconductor drum 213.

Developing device 212 includes a toner supplying section that supplies toner to a developer container, a carrier supplying section that supplies carrier to the developer container, and a toner concentration detection section that detects the toner concentration in the developer container (which are not illustrated in the drawings). The toner concentration detection section may be composed of a toner concentration sensor that detects a toner concentration based on variation of the permeability of the developer (toner and carrier) in the developer container, for example.

Control section 17 controls the operation of the toner supplying section or the carrier supplying section based on a result of the detection of the toner concentration detection section. In this manner, an appropriate amount of toner or carrier is replenished, and the toner concentration in the developer container is held at a toner concentration falling within a proper range. For example, when toner is consumed by an image formation process and the toner concentration is changed to a value equal to or lower than a predetermined value (about a lower limit of the proper range), toner is replenished.

Drum cleaning device 215 includes a drum cleaning blade that is brought into sliding contact with the surface of photoconductor drum 213, and removes residual toner that remains on the surface of photoconductor drum 213 after the primary transfer.

Intermediate transfer section 22 includes intermediate transfer belt 221, primary transfer roller 222, a plurality of support rollers 223, secondary transfer roller 224, belt cleaning device 225 and the like.

Intermediate transfer belt 221 is composed of an endless belt, and is stretched around the plurality of support rollers 223 in a loop form. At least one of the plurality of support rollers 223 is composed of a driving roller, and the others are each composed of a driven roller. When driving roller rotates, intermediate transfer belt 221 travels in arrow A direction at a constant speed.

Primary transfer rollers 222 are disposed on the inner periphery side of intermediate transfer belt 221 in such a manner as to face photoconductor drums 213 of respective color components. Primary transfer rollers 222 are brought into pressure contact with photoconductor drums 213 with intermediate transfer belt 221 therebetween, whereby a primary transfer nip (hereinafter referred to as "primary transfer section") for transferring a toner image from photoconductor drums 213 to intermediate transfer belt 221 is formed.

Secondary transfer roller 224 is disposed on the outer periphery side of intermediate transfer belt 221 in such a manner as to face one of support rollers 223. In the plurality of support rollers 223, support roller 223 that is so disposed as to face intermediate transfer belt 221 is referred to as a backup roller (hereinafter referred to as "backup roller 223A"). Secondary transfer roller 224 is brought into pressure contact with backup roller 223A with intermediate transfer belt 221 therebetween, whereby a secondary transfer nip (hereinafter referred to as "secondary transfer section") for transferring a toner image from intermediate transfer belt 221 to a sheet is formed.

In the primary transfer section, the toner images on photoconductor drums 213 are sequentially primary-transferred to intermediate transfer belt 221. To be more specific, a primary transfer bias is applied to primary transfer rollers 222, and electric charge of the polarity opposite to the polarity of the toner is applied to the rear side (the side that makes contact with primary transfer rollers 222) of intermediate transfer belt 221, whereby the toner image is electrostatically transferred to intermediate transfer belt 221.

Thereafter, when the sheet passes through the secondary transfer section, the toner image on intermediate transfer belt 221 is secondary-transferred to the sheet. To be more specific, a secondary transfer bias is applied to secondary transfer roller 224, and an electric charge opposite to that of the toner is applied to the rear side (the side that makes contact with secondary transfer roller 224) of the sheet, whereby the toner image is electrostatically transferred to the sheet. The sheet on which the toner image has been transferred is conveyed toward fixing section 23.

Belt cleaning device 225 includes a belt cleaning blade configured to make sliding contact with the surface of intermediate transfer belt 221, and the like, and removes transfer residual toner remaining on the surface of intermediate transfer belt 221 after the secondary transfer. Belt cleaning device 225 is utilized in a toner refreshing operation for forcibly outputting degraded toner in developing device 212.

Alternatively, in intermediate transfer section 22, it is also possible to adopt a configuration (so-called belt-type secondary transfer unit) in which a secondary transfer belt is installed in a stretched state in a loop form around a plurality of support rollers including a secondary transfer roller in place of secondary transfer roller 224.

Fixing section 23 includes upper fixing section 231 having a fixing side member disposed on a fixing surface (the surface on which a toner image is formed) side of a sheet, lower fixing section 232 having a back side supporting member disposed on the rear surface (the surface opposite to the fixing surface) side of a sheet, heating source 233 configured to heat the fixing side member, fixing temperature detection section 234 configured to detect a temperature (fixing temperature) of a region near the fixing side member, a pressure contact separation section (not illustrated) configured to bring the back side supporting member into pressure contact with the fixing side member, and the like.

For example, when upper fixing section 231 is of a roller heating type, the fixing roller serves as the fixing side member, and when upper fixing section 231 is of a belt heating type, the fixing belt serves as the fixing side member. In addition, for example, when lower fixing section 232 is of a roller pressing type, the pressure roller serves as the back side supporting member, and when lower fixing section 232 is of a belt pressing type, the pressing belt serves as the back side supporting member. FIG. 2 illustrates a configuration in which upper fixing section 231 is of a roller heating type, and lower fixing section 232 is of a roller pressing type.

Upper fixing section 231 includes upper fixing section-driving section (not illustrated) for rotating the fixing side member. When control section 17 controls the operation of the upper fixing section-driving section, the fixing side member rotates (travels) at a predetermined speed. Lower fixing section 232 includes lower fixing section-driving section (not illustrated) for rotating the back side supporting member. When control section 17 controls the operation of the lower fixing section-driving section, the back side supporting member rotates (travels) at a predetermined speed. It is to be noted that, in the case where the fixing side member follows the rotation of the back side supporting member, the upper fixing section-driving section is not required.

Heating source 233 is disposed inside or near the fixing side member. On the basis of the detection result of fixing temperature detection section 234 disposed at a position near the fixing side member, control section 17 controls the output of heating source 233. When control section 17 controls the output of heating source 233, the fixing side member is heated, and maintained at a predetermined temperature (for example, a fixable temperature, or a fixation idling temperature).

A pressure contact separation section (not illustrated) presses the back side supporting member against the fixing side member. The pressure contact separation section makes contact with both ends of a shaft that supports the back side supporting member to separately press each end. With this structure, the balance of the nip pressure in the direction along the shaft in the fixing nip can be adjusted. When control section 17 controls the operation of the pressure contact separation section (not illustrated) such that the back side supporting member is brought into pressure contact with the fixing side member, a fixing nip for conveying a sheet in a tightly sandwiching manner is formed.

Heat and pressure are applied to a sheet on which a toner image has been secondary-transferred and which has been conveyed along a sheet feeding path at the time when the sheet passes through fixing section 23. Thus, the toner image is fixed to the sheet.

Sheet introduction section 14 includes sheet introduction roller section 141 and the like for example, and sends a roll sheet fed from sheet feeding apparatus 1A into main conveyance section 16.

Sheet ejection section 15 includes sheet ejection roller section 151 and the like for example, and sends a roll sheet output from main conveyance section 16 into winding apparatus 1C.

Main conveyance section 16 includes a plurality of conveyance roller sections serving as sheet-conveyance elements for conveying sheets in a sandwiching manner. The conveyance roller sections include entry roller section 161 disposed on the upstream side of the secondary transfer section in the sheet conveyance direction. Main conveyance section 16 conveys a roll sheet introduced from sheet introduction section 14 through image forming section 20 (a secondary transfer section and fixing section 23), and conveys a sheet output from image forming section 20 (fixing section 23) toward sheet ejection section 15.

When an image is formed on a roll sheet, a roll sheet fed from sheet feeding apparatus 1A is introduced through sheet introduction section 14. The roll thus introduced is conveyed to image forming section 20 by sheet main conveyance section 16. Thereafter, a toner image on intermediate transfer belt 221 is secondary-transferred to a surface of the roll sheet at one time at the time when the roll sheet passes through the secondary transfer section, and then a fixing process is performed in fixing section 23. The roll sheet on which an image has been formed is ejected out of the apparatus from sheet ejection section 15, and wound by roll winding section 92 of winding apparatus 1C. As described, the sheet conveyance section of image forming apparatus main body 1B is configured by sheet introduction section 14, sheet ejection section 15, and main conveyance section 16.

In image forming apparatus 1, when a low-coverage image is continuously formed, the toner housed in developing device 212 is degraded, causing problems such as image fogging, and therefore, a toner refreshing operation for replacing old toner with new toner is required to be performed. However, when an image is formed on a roll sheet, toner refreshing operation cannot be performed at intervals between sheets as in the case of image formation on flat sheets. In the present embodiment, a toner refreshing operation is performed at an interval between jobs (which includes the case where the next job is not performed), that is, at a period between the completion of an image formation process of a preceding printing job (hereinafter referred to as "preceding job") and the start of an image formation process of a succeeding printing job (hereinafter referred to as "next job").

During the interval between jobs, the fixing temperature is higher than the fixation idling temperature, and discoloration or deformation due to the heat may possibly be caused when the roll sheet stays at fixing section 23, and in view of this, conveyance of the roll sheet is continued. At this time, to reduce the waste sheet, the conveyance speed of the roll sheet is changed to a low speed (1/10 of the speed during image formation, for example).

The toner refreshing operation includes a first toner refreshing operation (first TR operation) in which an ejection toner image is formed on intermediate transfer belt 221 and removed by belt cleaning device 225. During the interval between jobs, the pressure contact between intermediate transfer belt 221 and the roll sheet can be released, and therefore the first toner refreshing operation can be performed during the interval between jobs. The ejection toner image formed on intermediate transfer belt 221 passes through the secondary transfer section, and the ejection toner is removed by belt cleaning device 225.

In this case, if a large amount of toner is ejected at a time, the load exerted on cleaning apparatus 225 is increased and the lifetime of the cleaning member (for example, the lifetime of the cleaning blade) is shortened, thus resulting in degradation in image quality due to passing of toner and the like. In view of this, in the first toner refreshing operation, toner is ejected little by little by taking a long time so that an excessive load is not exerted on belt cleaning device 225 (see FIG. 4A).

In addition, the toner refreshing operation includes a second toner refreshing operation (second TR operation) in which an ejection toner image is formed on intermediate transfer belt 221 and the image is transferred and fixed to a roll sheet. In the second toner refreshing operation, the fixing temperature and the conveyance speed of the roll sheet are set to values same as those of image formation in order to ensure a fixation performance of the ejection toner image. In the second toner refreshing operation, since the ejection toner image is transferred to a roll sheet being conveyed, a large amount of degraded toner can be ejected at a time in a short time (see FIG. 4B).

For example, in the second toner refreshing operation, the ejection toner image may be a solid image having a maximum image density and a large planar dimension. On the other hand, in the first toner refreshing operation, an image (for example, a solid image having a low image density or a solid image having a small planar dimension) whose toner consumption amount (toner adhesion amount) per unit time is small in comparison with the ejection toner image used in the second toner refreshing operation is used as the ejection toner image. With this configuration, it is possible to reduce the load exerted by the first toner refreshing operation on belt cleaning device 225.

In addition, the ejection toner image used for the toner refreshing operation may include a chart image for adjusting the condition of the image creation process (the charging potential, light exposure intensity, development potential, image writing position and the like). Thus, since the part where the chart image is to be formed is not the waste sheet, the waste sheet can be reduced, and unpleasant feeling of the user for ejection of the ejection toner image to the roll sheet can be reduced. In this case, an image detection section (not illustrated) such as a line sensor detects the chart image, and the image creation condition is adjusted in accordance with a result of the detection.

Figure 4A:
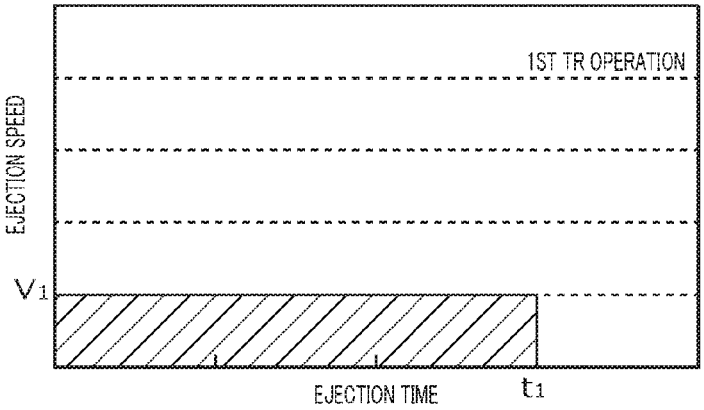
FIG. 4A shows an amount of toner ejected in a first toner refreshing operation.

As shown in FIG. 4A, in the first toner refreshing operation, toner ejection velocity V1 is low and toner refreshing time t1 is long in comparison with the second toner refreshing operation; however, advantageously, the waste sheet resulting from toner ejection is not generated. In addition, since the roll sheet is not contaminated or damaged by the ejection toner image, the appearance of the roll sheet is not degraded. It is to be noted that, even when the first toner refreshing operation is executed at an interval between jobs, conveyance of the roll sheet is continued to prevent the roll sheet from being discolored or deformed due to heat, and thus the waste sheet may possibly be generated.

Figure 4B:
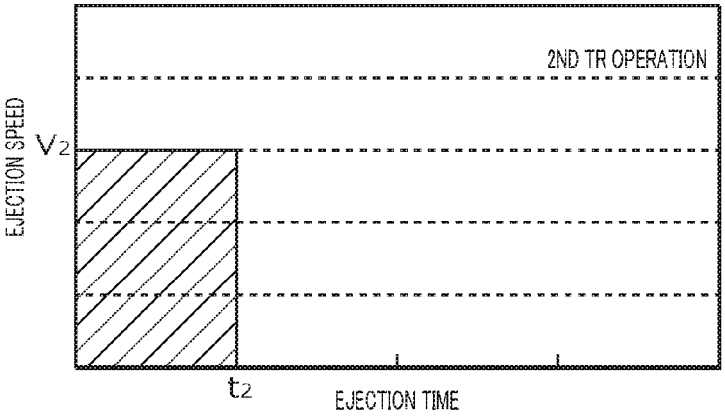
FIG. 4B shows an amount of toner ejected in a second toner refreshing operation.

As shown in FIG. 4B, in the second toner refreshing operation, toner refreshing time t2 is advantageously short in comparison with the first toner refreshing operation. However, the waste sheet is resulting from toner ejection, and appearance is degraded. It is to be noted that, during the interval between jobs, conveyance of the roll sheet is continued to prevent the roll sheet from being discolored or deformed due to heat and thus the waste sheet is generated, and, the amount of the waste sheet is large since the conveyance speed of the roll sheet in the second toner refreshing operation is equal to that of image formation.

From the foregoing, the first toner refreshing operation is favorable for the user who wants to reduce the waste sheet without degrading the appearance, and the second toner refreshing operation is favorable for the user who wants to shorten the toner refreshing time even if the appearance is sacrificed to some extent.

Figure 4C:
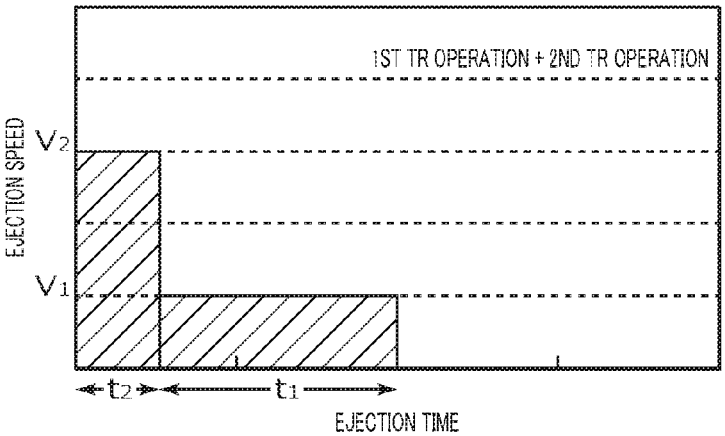
FIG. 4C shows an amount of toner ejected in the first and second toner refreshing operations.

In addition, image forming apparatus 1 may perform a toner refreshing operation in which the first toner refreshing operation and the second toner refreshing operation are combined as shown in FIG. 4C. This operation is favorable for the user who wants to reduce the waste sheet resulting from toner ejection and shorten the toner refreshing time. In this case, execution time t1 of the first toner refreshing operation and execution time t2 of the second toner refreshing operation are determined based on the interval time between jobs and the amount of toner to be ejected.

For example, when the next job is not to be performed, the interval time between jobs is long (in an extreme case, ∞), and therefore only the first toner refreshing operation is performed.

In addition, when the fixing temperature is required to be raised or reduced at the time of starting an image formation process of the next job, the interval time between jobs is a preparation period (a warming-up period or a cooling-down period) for stabilizing the fixing temperature. For example, when the printing mode (gloss mode/normal mode) of the next job differs from that of the preceding job, the fixing temperature is required to be changed.

In addition, when the image formation of the next job is quickly started after the image formation process of the preceding job is completed, the interval time between jobs is short (in an extreme case, 0), and therefore only the second toner refreshing operation is performed.

FIG. 5A and FIG. 5B illustrate exemplary operation screens for setting the toner refreshing operation. Each of the operation screens illustrated in FIG. 5A and FIG. 5B is displayed on display section 121 when an operation for setting the toner refreshing operation is performed at operation section 122. On the operation screens illustrated in FIG. 5A and FIG. 5B, the user can readily select a desired toner refreshing operation.

As illustrated in FIG. 5A and FIG. 5B, message M1 that requests the user to select whether to allow for toner ejection to the roll sheet, and selection options "YES" and "NO" are displayed on the operation screen, for example. When "YES" is selected in response to message M1, toner ejection to the roll sheet is allowed, and when "NO" is selected in response to message M1, toner ejection to the roll sheet is inhibited.

In addition, message M2 that requests to select a toner refreshing operation, and selection options "1. WASTE SHEET REDUCTION MODE," "2. TIME SHORTENING MODE," and "3. RECOMMENDED MODE" are displayed on the operation screen. The first toner refreshing operation is executed when "1. WASTE SHEET REDUCTION MODE" is selected in response to message M2, the second toner refreshing operation is executed when "2. TIME SHORTENING MODE" is selected in response to message M2, and the combination of the first toner refreshing operation and the second toner refreshing operation is executed when "3. RECOMMENDED MODE" is selected in response to message M2.

FIG. 5A illustrates a case where toner ejection to the roll sheet is allowed, and "3. RECOMMENDED MODE" is selected. FIG. 5B illustrates a case where toner ejection to the roll sheet is inhibited, and "1. WASTE SHEET REDUCTION MODE" is selected. In a case where toner ejection to the roll sheet is inhibited as illustrated in FIG. 5B, it is preferable to disable selection of "2. TIME SHORTENING MODE" and "3. RECOMMENDED MODE" so that the second toner refreshing operation is not executed. It is to be noted that, in the default setting, toner ejection to the roll sheet is allowed and "3. RECOMMENDED MODE" is selected, for example.

Figure 6:
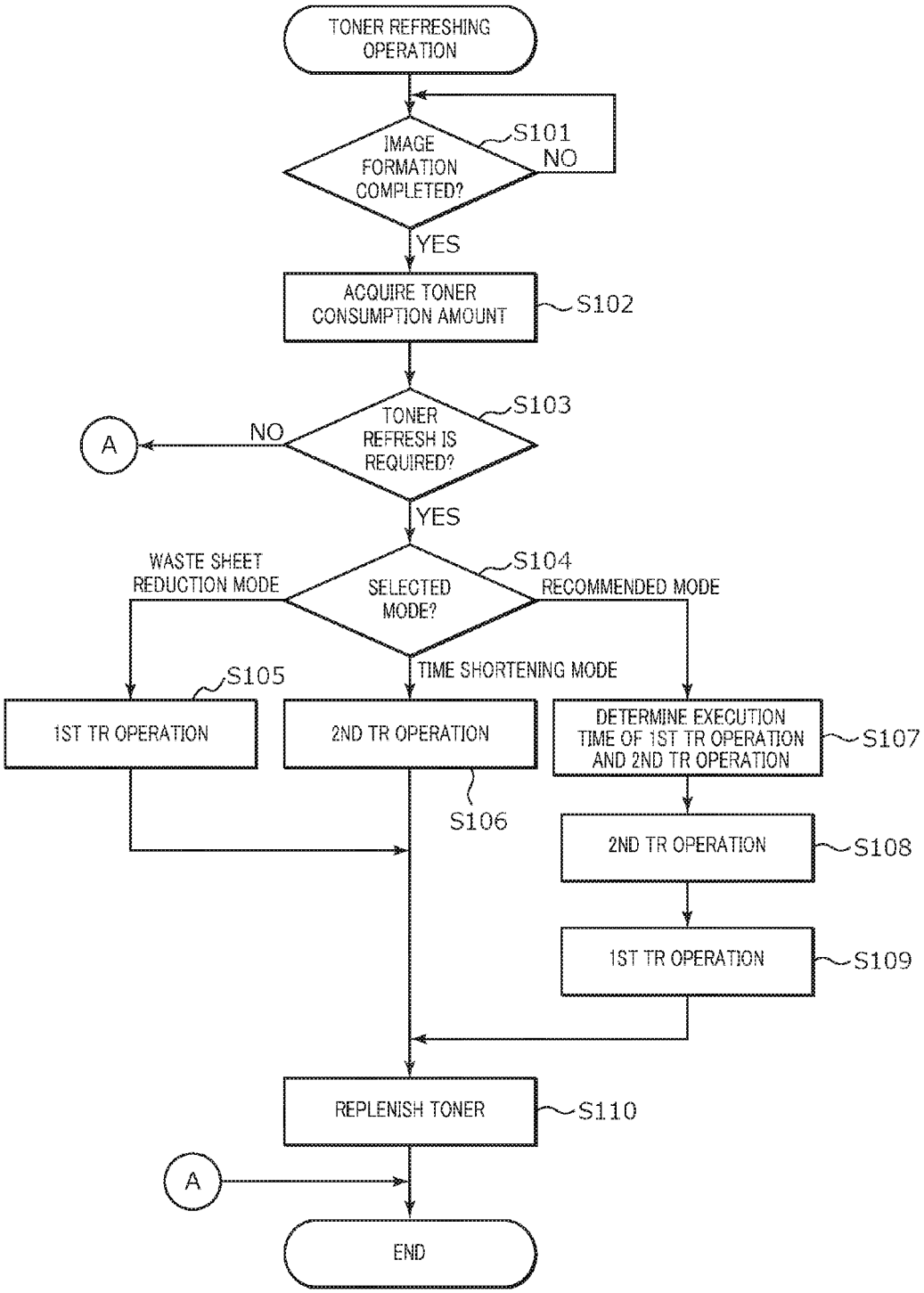
FIG. 6 is an exemplary flowchart of a toner refreshing process.

FIG. 6 is a flowchart of an exemplary toner refreshing process. This process is achieved when CPU 171 executes a predetermined program stored in ROM 172 upon the start of an image formation process on a sheet in image forming apparatus 1, for example. It is to be noted that the toner refreshing operation executed during the interval between jobs may be set prior to the printing job, or may be reset during the printing job or the toner refreshing operation by the user.

At step S101, control section 17 determines whether a series of image formation processes included in one printing job have been completed. When the series of image formation processes have been completed, the process is advanced to step S102.

At step S102, control section 17 acquires toner amount T1 (hereinafter referred to as "toner consumption amount T1") consumed through the image formation process included in the executed printing job. Toner consumption amount T1 may be calculated based on coverage information included in the printing job, or with use of the amount of the toner replenished in the toner concentration control.

At step S103, control section 17 compares degraded toner amount T0 with actual toner consumption amount T1 to determine whether the toner refreshing operation is required. Degraded toner amount T0 increases in proportion to the duration of the image formation process (the agitation time of developer), and is calculated on the basis of the amount of the degraded toner per unit time (unit sheet) set in advance. When toner consumption amount T1 is smaller than degraded toner amount T0, control section 17 determines that the toner refreshing operation is required. When a low-coverage image is continuously formed, actual toner consumption amount T1 decreases, and consequently toner amount T that has to be ejected (degraded toner amount T0−toner consumption amount T1) increases. When the toner refreshing operation is required (at step S103 "YES"), the process is advanced to step S104. When the toner refreshing operation is not required (at step S103 "NO"), the toner refreshing process is completed.

At step S104, control section 17 determines the toner refresh mode set by the user. The process is advanced to step S105 when the waste sheet reduction mode is set, advanced to step S106 when the time shortening mode is set, and advanced to step S107 when the recommended mode is set (see FIG. 5A and FIG. 5B).

At step S105, control section 17 executes the first toner refreshing operation. Specifically, an ejection toner image is formed on intermediate transfer belt 221 by toner image forming section 21, and the ejection toner image passes through the secondary transfer section and removed by belt cleaning device 225 for intermediate transfer belt 221. The first toner refreshing operation requires a long time, but does not transfer the ejection toner image to the roll sheet and therefore does not generate the waste sheet resulting from the toner ejection. In this case, while the toner refreshing time is assumed to be longer than the interval time between jobs, and the next job is executed after the first toner refreshing operation is completed.

At step S106, control section 17 executes the second toner refreshing operation. That is, an ejection toner image is formed on intermediate transfer belt 221 by toner image forming section 21, and the ejection toner image is transferred to the roll sheet in the secondary transfer section and fixed in fixing section 23. The second toner refreshing operation can complete the toner refreshing operation in a short time although the waste sheet is increased because of the conveyance speed of the roll sheet equal to that of the image formation.

At step S107, control section 17 calculates execution time t1 of the first toner refreshing operation and execution time t2 of the second toner refreshing operation based on the interval time between jobs. At this time, by determining the times such that first toner refreshing operation time t1 is maximized, the interval time between jobs can be effectively utilized as much as possible, and the waste sheet resulting from toner ejection can be reduced as much as possible.

At step S108, control section 17 executes the second toner refreshing operation. At step S109, control section 17 executes the first toner refreshing operation. When the recommended mode is selected as the toner refresh mode, only the first toner refreshing operation or only the second toner refreshing operation may be performed depending on the interval time between jobs. The user can reduce the waste sheet resulting from toner ejection and can shorten the toner refreshing time.

While the second toner refreshing operation may be executed after the first toner refreshing operation is executed, it is preferable to execute the second toner refreshing operation first since the second toner refreshing operation is performed under an image formation condition (fixing temperature, conveyance speed and the like) same as that of the image formation.

At step S110, based on a detection result of the toner concentration detection section (not illustrated), control section 17 controls the toner supplying section (not illustrated) to replenish toner by an amount consumed by the first toner refreshing operation or the second toner refreshing operation.

Image forming apparatus 1 includes: sheet conveyance section (sheet introduction section 14, sheet ejection section 15, and main conveyance section 16) capable of conveying a roll sheet (long sheet); image forming section 20 configured to form an image on intermediate transfer belt 221 (image bearing member) by supplying toner from developing device 212, and transfer and fix the toner image to the long sheet conveyed by the sheet conveyance section (14, 15, 16); and control section 17 configured to control a toner refreshing operation in which toner housed in developing device 212 is ejected by an amount required to be ejected and is replaced with new toner. The toner refreshing operation includes a first toner refreshing operation and a second toner refreshing operation, the first toner refreshing operation being an operation in which an ejection toner image is formed on the intermediate transfer belt 221 and removed by belt cleaning device 225 (a cleaning section for the image bearing member), the second toner refreshing operation being an operation in which an ejection toner image is formed on intermediate transfer belt 221 and the ejection toner image thus formed is transferred and fixed to the long sheet conveyed by sheet conveyance section (14, 15, 16). When the toner refreshing operation is required ("YES" at step S103 of FIG. 6), control section 17 executes the first toner refreshing operation or the second toner refreshing operation during an interval between jobs, the interval being a period between completion of an image formation process of a preceding printing job and start of an image formation process of a succeeding printing job.

When forming an image on a roll sheet, image forming apparatus 1 can efficiently perform toner refreshing in accordance with the applications of the user without degrading the quality as a long product. In addition, since the degraded toner in developing device 212 is replaced with new toner, problems such as image fogging due to increase in degraded toner can be prevented, and favorable image quality can be ensured.

While the invention made by the present inventor has been specifically described based on the preferred embodiments, it is not intended to limit the present invention to the above-mentioned preferred embodiments but the present invention may be further modified within the scope and spirit of the invention defined by the appended claims.

While image forming apparatus 1 of an intermediate transfer type has been described in the embodiment, the present invention can be applied also to an image forming apparatus of a direct transfer type in which a toner image is directly transferred from a photoconductor to a sheet. In this case, the photoconductor serves as the image bearing member of the embodiment of the present invention.

In addition, when the toner refreshing operation is required, degraded toner may be ejected (auxiliary refreshing operation) by forming an ejection toner image little by little in a non-image forming region (including a region between a preceding image and a succeeding image included in one printing job) of a roll sheet. In this case, whether the toner refreshing operation is required is periodically determined during an image formation process of one printing job, for example. Preferably, the ejection toner image is an image that does not make the user uncomfortable such as a crop mark and a chart image for adjusting the condition of the image creation process. In this manner, it is possible to reduce the amount of toner to be ejected by the toner refreshing operation performed after the image formation is completed, and thus the execution time of the toner refreshing operation can be shortened. In addition, when the first toner refreshing operation is performed, the burden of belt cleaning device 225 can be reduced.

In addition, it is also possible to adopt a configuration in which the toner refreshing operation is changed during the first toner refreshing operation or the second toner refreshing operation. Such a configuration is suitable for a case where the next job is required to be urgently executed when the first toner refreshing operation has been selected on the assumption that the interval between jobs is long, for example.

The embodiment disclosed herein is merely an exemplification and should not be considered as limitative. The scope of the present invention is specified by the following claims, not by the above-mentioned description. It should be understood that various modifications, combinations, sub-combinations and alterations may occur depending on design requirements and other factors in so far as they are within the scope of the appended claims or the equivalents thereof.

What is claimed is:

1. An image forming apparatus comprising:

a sheet conveyance section capable of conveying a long sheet;

an image forming section configured to form a toner image on an image bearing member by supplying toner from a toner development section, and transfer and fix the toner image to the long sheet conveyed by the sheet conveyance section; and a control section configured to control a toner refreshing operation in which toner housed in the development section is ejected by an amount required to be ejected and is replaced with new toner, wherein the toner refreshing operation includes a first toner refreshing operation and a second toner refreshing operation, the first toner refreshing operation being an operation in which an ejection toner image is formed on the image bearing member and removed by a cleaning section for the image bearing member, the second toner refreshing operation being an operation in which an ejection toner image is formed on the image bearing member and the ejection toner image thus formed is transferred and fixed to the long sheet conveyed by the sheet conveyance section, and, when the toner refreshing operation is required, the control section executes the first toner refreshing operation or the second toner refreshing operation during an interval between jobs, the interval being a period between completion of an image formation process of a preceding printing job and start of an image formation process of a succeeding printing job.

2. The image forming apparatus according to claim 1 further comprising an operation section configured to receive a request relating to the toner refreshing operation from a user, wherein, on a basis of operation information from the operation section, the control section determines the toner refreshing operation to be executed.

3. The image forming apparatus according to claim 1, wherein the control section determines an execution time of the first toner refreshing operation and the second toner refreshing operation based on a time of the interval between jobs and an amount of toner to be ejected.

4. The image forming apparatus according to claim 1, wherein, when executing the first toner refreshing operation and the second toner refreshing operation, the control section executes the second toner refreshing operation first.

5. The image forming apparatus according to claim 1, wherein a consumption amount of toner per unit time for the ejection toner image in the first toner refreshing operation is smaller than a consumption amount of toner per unit time for the ejection toner image in the second toner refreshing operation.

6. The image forming apparatus according to claim 1, wherein the ejection toner image includes a chart image for adjusting a condition of an image creation process.

7. The image forming apparatus according to claim 1 further comprising:

a sheet feeding section configured to feed a roll sheet to the sheet conveyance section; and a winding section configured to wind up the roll sheet output from the sheet conveyance section.

* * * * *